US009664474B2

(12) United States Patent
Barnett

(10) Patent No.: US 9,664,474 B2
(45) Date of Patent: May 30, 2017

(54) CROSSBOW CASE INCLUDING ETHYLENE-VINYL ACETATE

(71) Applicant: BARNETT OUTDOORS, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 14/990,337

(22) Filed: Jan. 7, 2016

(65) Prior Publication Data

US 2016/0195358 A1 Jul. 7, 2016

Related U.S. Application Data

(60) Provisional application No. 62/100,832, filed on Jan. 7, 2015.

(51) Int. Cl.
*F41B 5/14* (2006.01)

(52) U.S. Cl.
CPC ..... *F41B 5/1457* (2013.01)

(58) Field of Classification Search
CPC ..... F41B 5/14; F41B 5/1457
USPC ..... 206/315.11
See application file for complete search history.

(56) References Cited

U.S. PATENT DOCUMENTS 6,935,495 B1 * 8/2005 Mc Kenzie ..... A45C 13/02 206/315.11
7,909,161 B2 * 3/2011 Sween ..... A45C 3/02 190/109
8,584,846 B2 * 11/2013 Whalen ..... F41B 5/12 206/315.1
8,978,949 B2 * 3/2015 Arajakis ..... F41B 5/1457 224/153

* cited by examiner

*Primary Examiner* — Bryon Gehman
(74) *Attorney, Agent, or Firm* — Jones Walker LLP

(57) ABSTRACT

A crossbow case with an exterior shell and an interior compartment within the exterior shell. The exterior shell is made of ethylene-vinyl acetate. The exterior shell has a thickness in the range of about 1/16 to 1/4 of an inch. The exterior shell includes a top member and a bottom member in a hinged configuration.

19 Claims, 11 Drawing Sheets

CROSSBOW CASE INCLUDING ETHYLENE-VINYL ACETATE

CROSS-REFERENCE TO RELATED APPLICATIONS

This application claims priority to and the benefit of U.S. Provisional Patent Application No. 62/100,832, filed on 7 Jan. 2015, which is incorporated by reference in its entirety herein.

BACKGROUND OF THE INVENTION

The invention relates to crossbow cases.

Conventional crossbow cases are formed of hard plastics, polypropylene plastics, nylons, or soft fabrics. While the hard plastic cases provide a hard protective surface, the fabrication process for these cases requires expensive tooling. The production of the fabric cases is labor intensive due to sewing requirements. The fabric cases have a soft texture, but provide less protection of the crossbow held inside, increasing the likelihood of damage to the crossbow.

SUMMARY OF THE INVENTION

In an embodiment, a crossbow case may comprise an exterior shell and an interior compartment within the exterior shell. The exterior shell may comprise ethylene-vinyl acetate. The interior compartment may be dimensioned to house a crossbow. The interior compartment may also be dimensioned to house a crossbow and one or more crossbow accessories. The exterior shell may include a camouflage pattern. A foam insert may be disposed within the interior compartment. The exterior shell may include a top member and a bottom member. The top member and the bottom member may be connected with hinges positioned at a forward end of the crossbow case. The top member and the bottom member may also be connected with hinges positioned at a rearward end of the crossbow case. The exterior shell may include one or more apertures dimensioned to allow placement of a foot stirrup of a crossbow. The exterior shell may have a thickness of about 1/16 to about 1/4 of an inch. The exterior layer may include an ethylene-vinyl acetate layer. The ethylene-vinyl acetate layer may have a thickness of about 1/16 to about 1/4 of an inch.

DETAILED DESCRIPTION OF THE PREFERRED EMBODIMENTS

Figure 1:
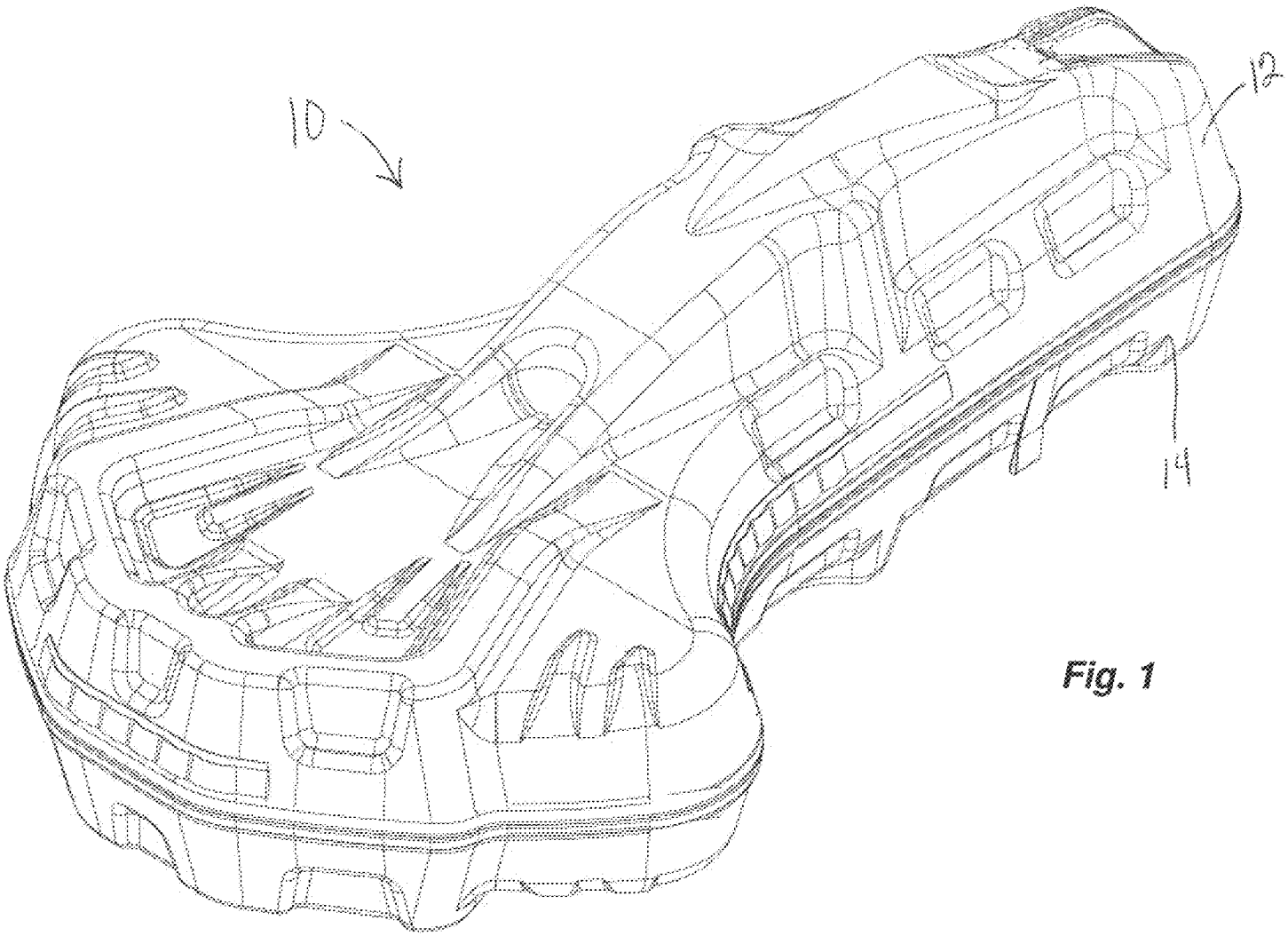
FIG. 1 is a top perspective view of a crossbow case.
Figure 2:
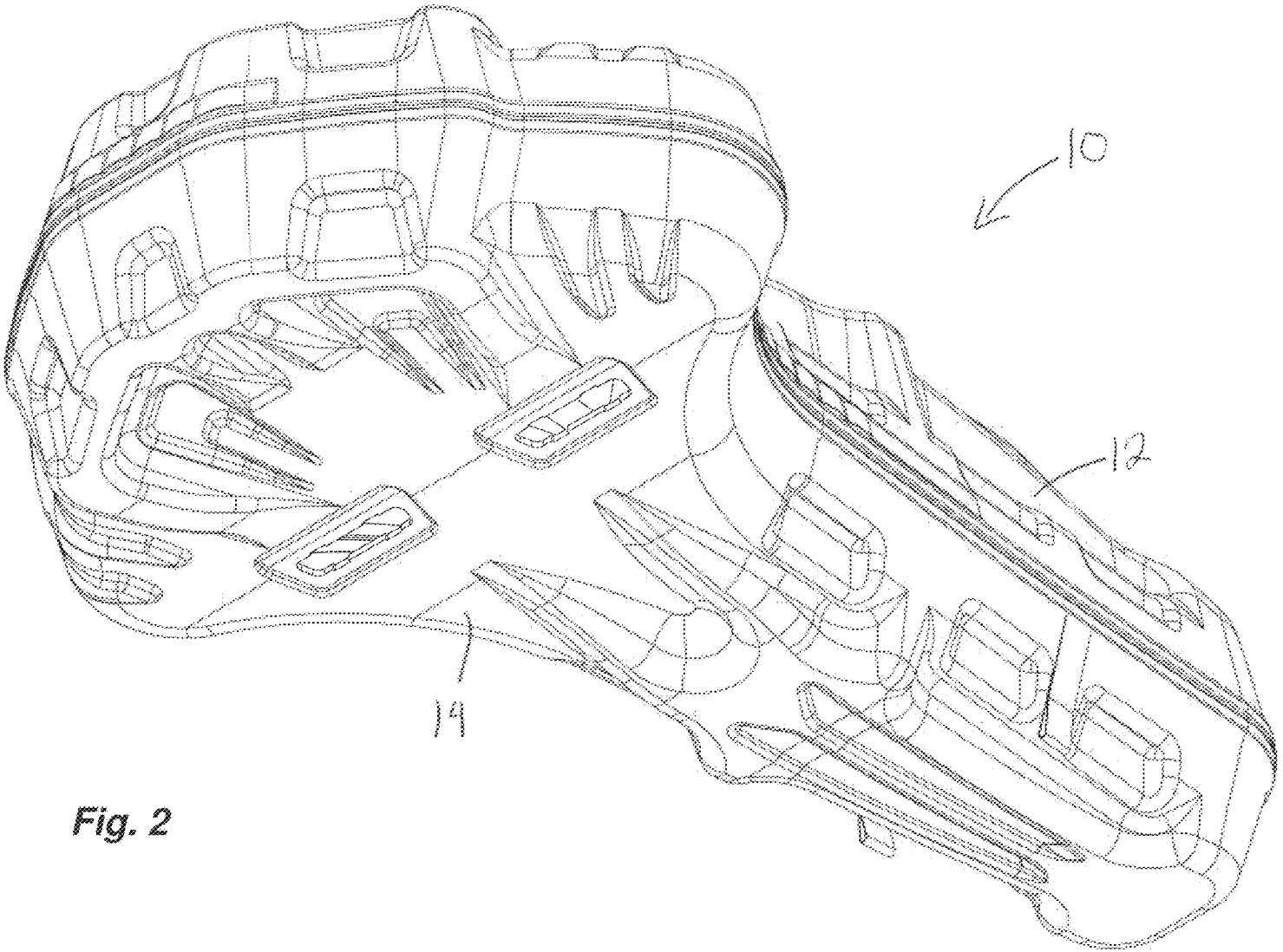
FIG. 2 is a bottom perspective view of the crossbow case.
Figure 3:
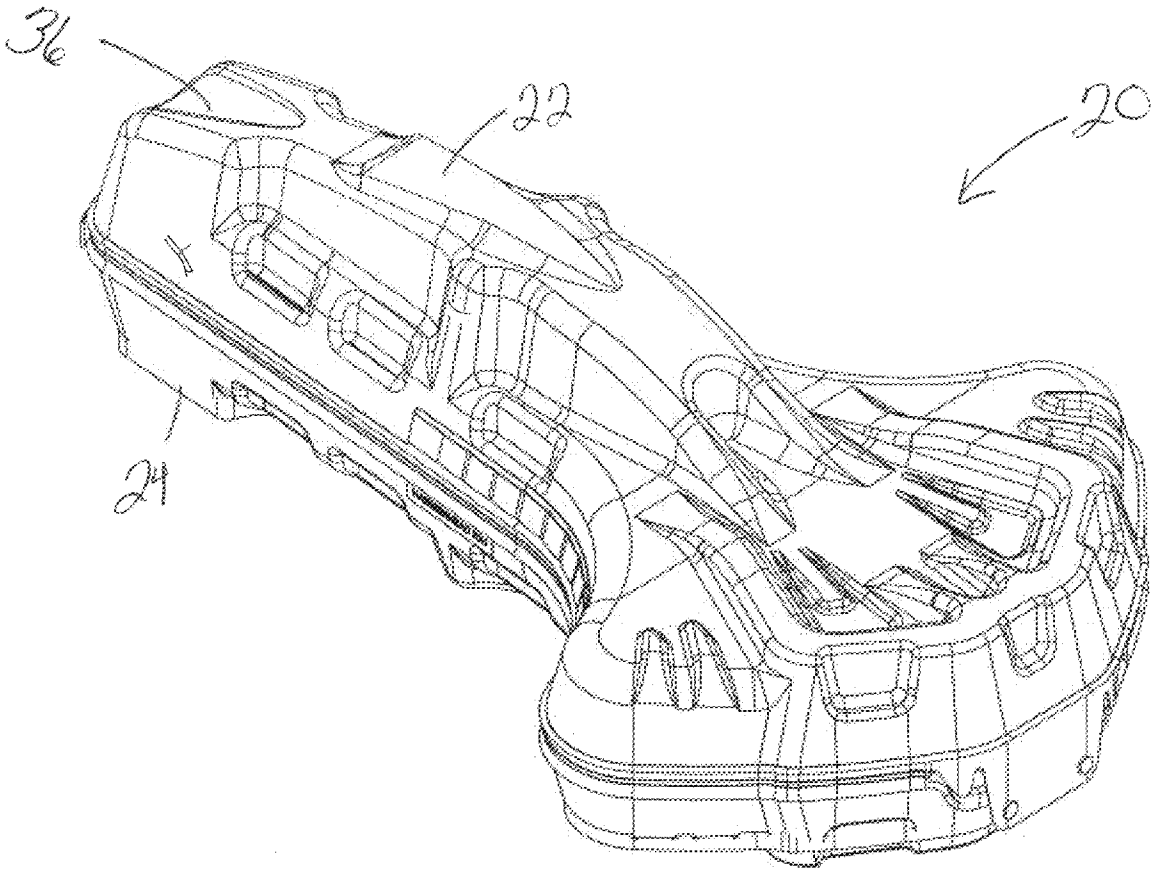
FIG. 3 is a top perspective view of an alternate embodiment of the crossbow case.
Figure 4:
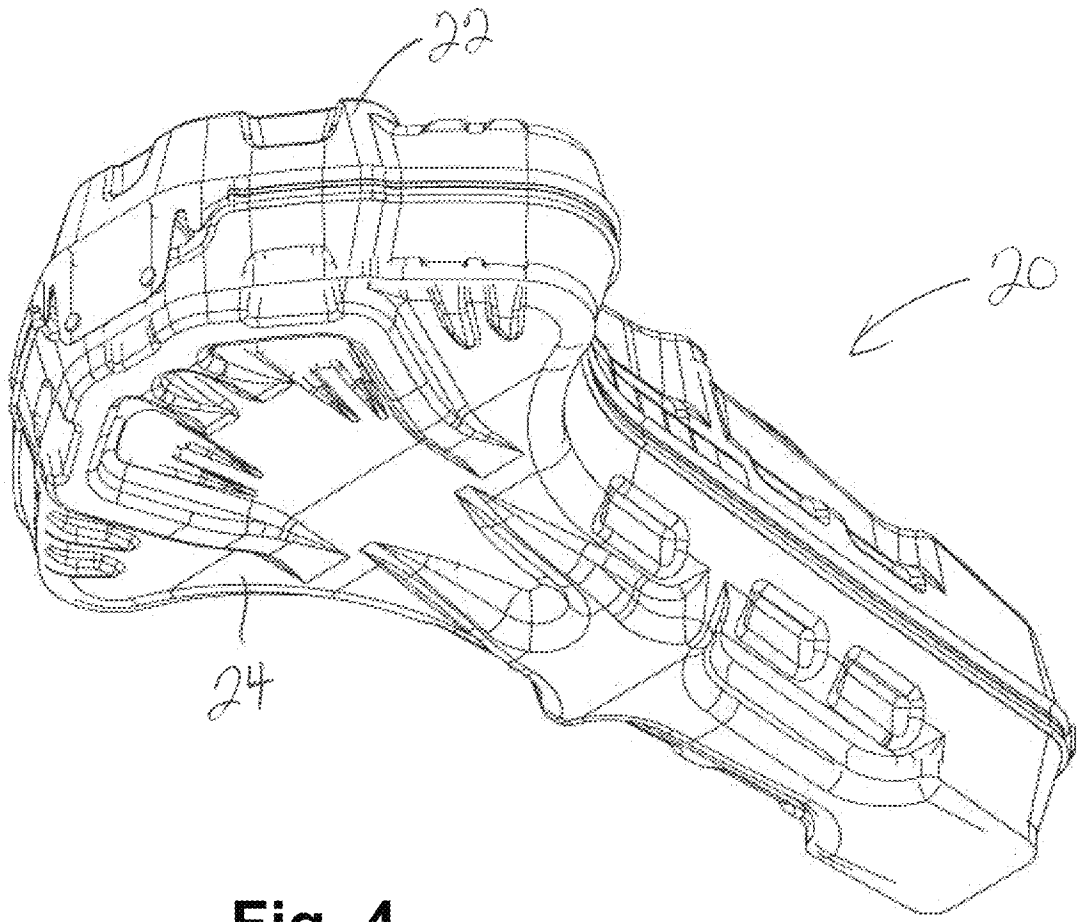
FIG. 4 is a bottom perspective view of the alternate embodiment of the crossbow case.
Figure 5:
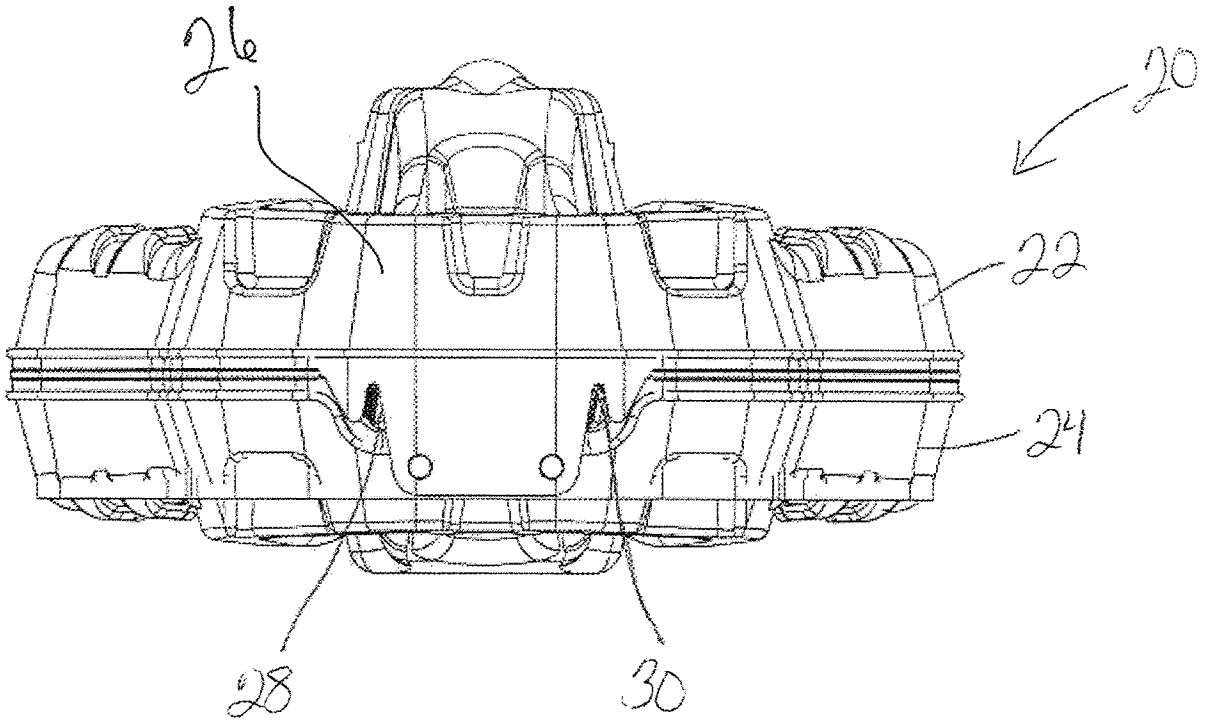
FIG. 5 is a front view of the alternate embodiment of the crossbow case.
Figure 6:
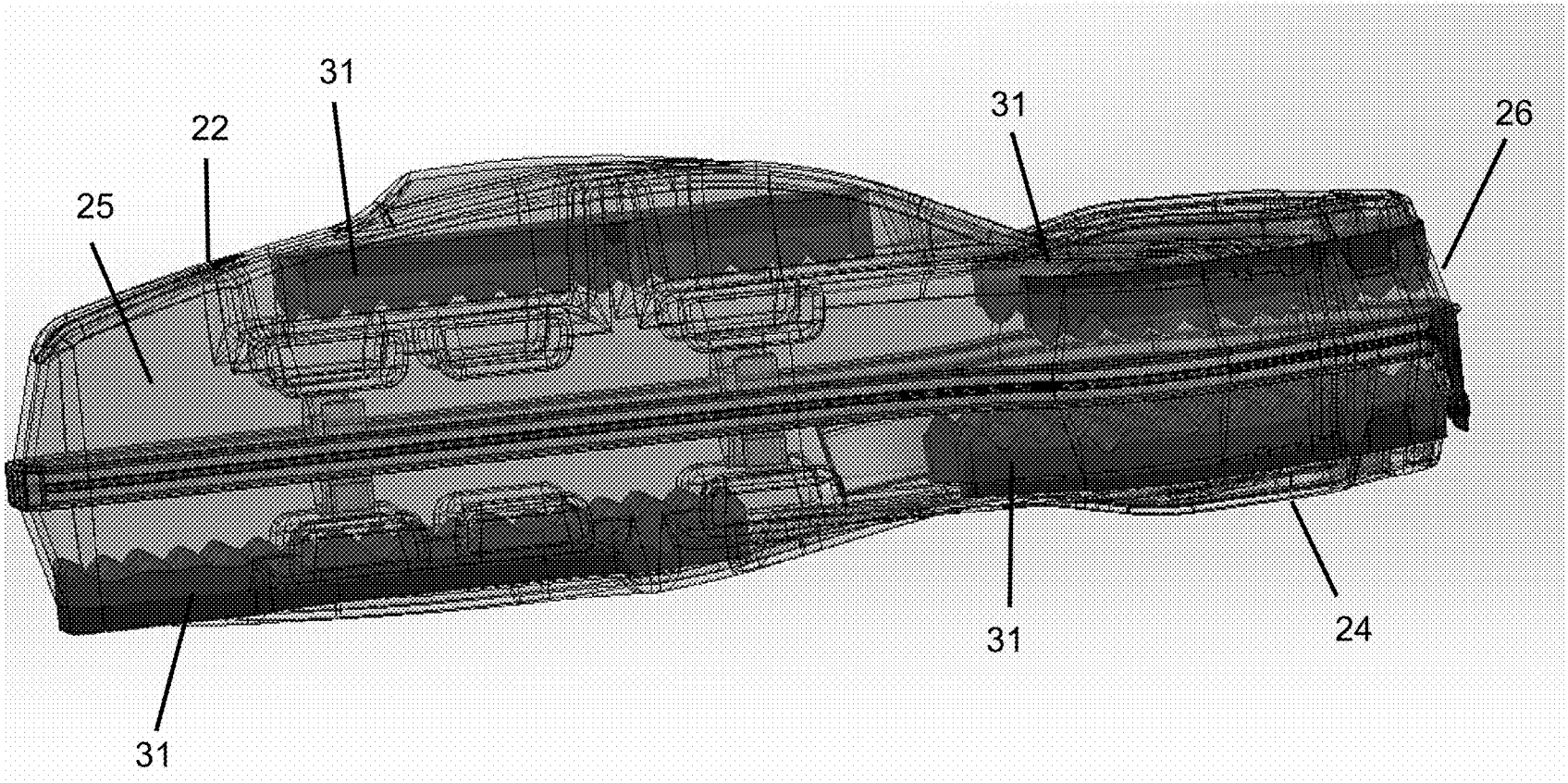
FIG. 6 is a side view of the alternate embodiment of the crossbow case with an exterior shell of the crossbow case illustrated as transparent to show an interior compartment.
Figure 7:
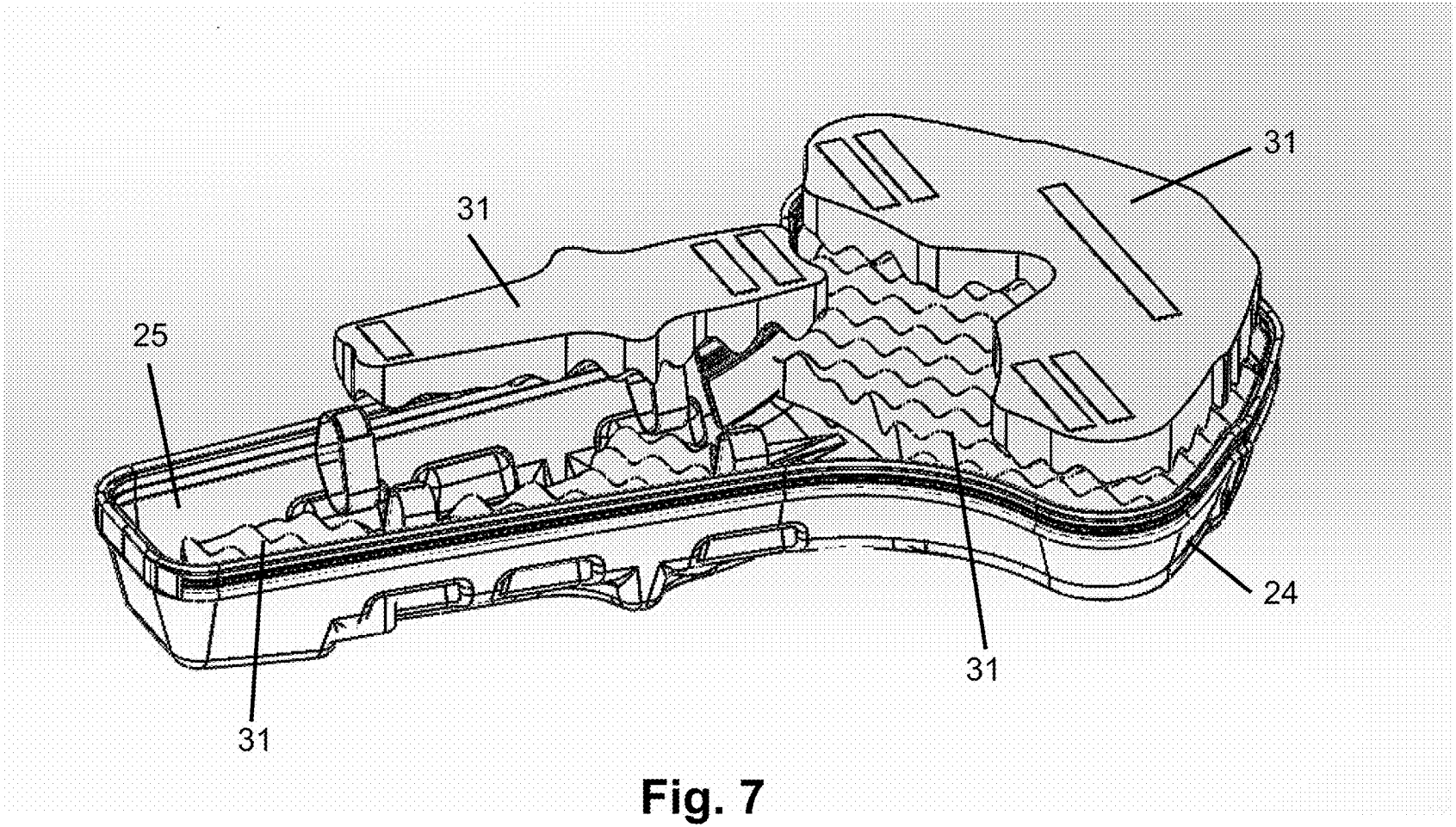
FIG. 7 is a top perspective view of a bottom member of the alternate embodiment of the crossbow case with foam inserts disposed within an interior compartment of the crossbow case.

FIGS. 1 and 2 illustrate crossbow case 10. The exterior of crossbow case 10 is formed of ethylene-vinyl acetate (EVA). EVA allows for a hard and durable protective surface, but a soft texture. While not available with conventional hard crossbow cases, EVA also allows for printing of a pattern on the exterior surface of crossbow case 10. For example, crossbow case 10 may include a camouflage pattern printed on its exterior surface. In one embodiment, the EVA surface may have a thickness of about 1/16 to 1/4 of an inch.

In another embodiment, the exterior of crossbow case 10 may include EVA with an outer layer attached to the outer surface of the EVA and an inner layer attached to the inner surface of the EVA. For example, the outer and inner layers may be formed of a thin fabric, such as nylon or velvet. The outer and inner layers may include a pattern such as a camouflage pattern.

Crossbow case 10 may include top member 12 and bottom member 14, which may be connected with hinges. Crossbow case 10 is dimensioned to house a crossbow in an interior compartment. In one embodiment, crossbow case 10 may be dimensioned to house a crossbow along with arrows, quivers, scopes, rope cocking devices, and other accessories. Crossbow case 10 may include one or more foam inserts disposed within the interior compartment. The foam inserts may protect the crossbow and any accessories housed within the interior compartment during storage and transportation.

Referring to FIGS. 3-7, crossbow case 20 may also have an exterior formed of EVA, with or without an inner layer and an outer layer. Crossbow case 20 may include top member 22, bottom member 24, and interior compartment 25. Front end 26 of crossbow case 20 may include apertures 28 and 30. Apertures 28 and 30 may be dimensioned to receive a foot stirrup of a crossbow positioned within interior compartment 25 of crossbow case 20. Crossbow case 20 may be shorter than conventional crossbow cases due to the allowance of foot stirrup though front end 26 of crossbow case 20. For example, crossbow case 20 may be 4 inches shorter than conventional crossbow cases that house the foot stirrup inside an interior compartment.

With reference again to FIGS. 6 and 7, crossbow case 20 may also include one or more foam inserts 31 disposed within interior compartment 25. Foam inserts 31 may protect a crossbow and any accessories housed within interior compartment 25. Foam inserts 31 may be strategically positioned within interior compartment 25 such that foam inserts 31 provide additional protection for certain portions of a crossbow. For example, foam inserts 31 may be positioned to protect a scope, a butt, or cams of a crossbow. Foam inserts 31 or similar foam inserts may be used in the interior compartment of crossbow case 10.

Figure 8:
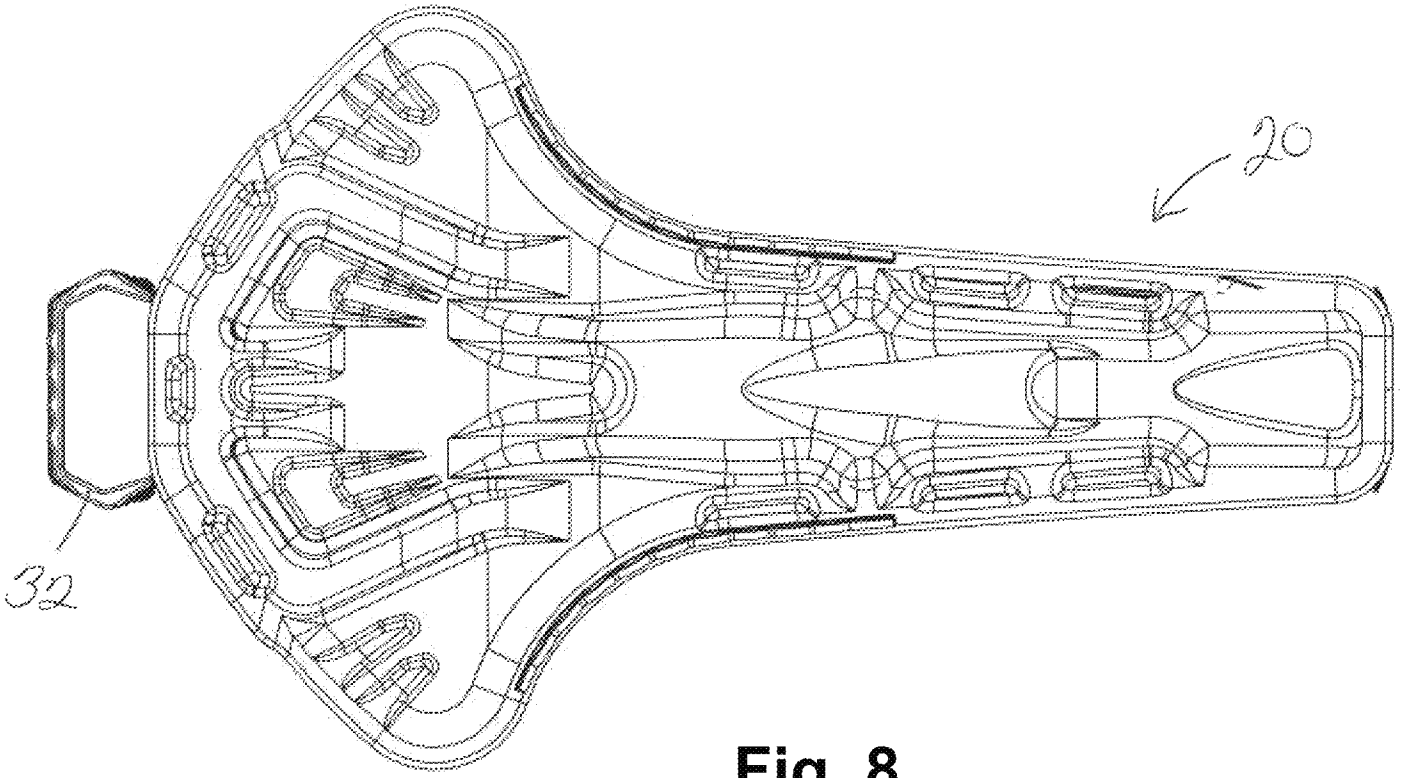
FIG. 8 is a top view of the alternate embodiment of the crossbow case housing a crossbow.
Figure 9:
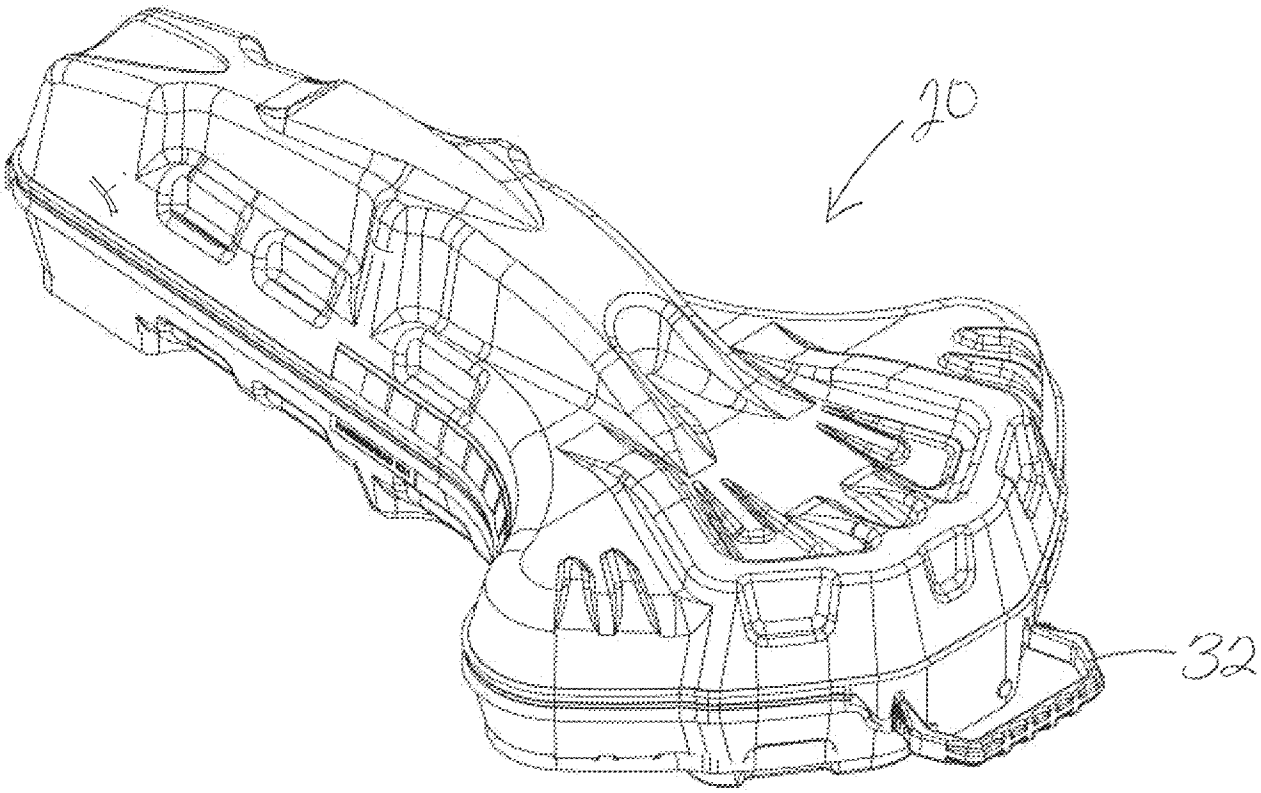
FIG. 9 is a top perspective view of the alternate embodiment of the crossbow case housing a crossbow.
Figure 10:
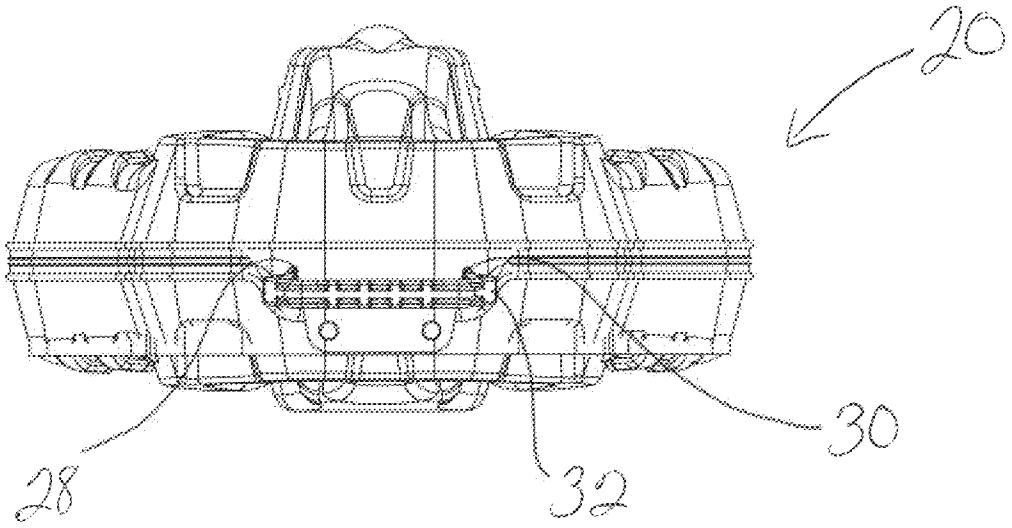
FIG. 10 is a front view of the alternate embodiment of the crossbow case housing a crossbow.

With reference now to FIGS. 8-10, a crossbow may be positioned within interior compartment 25 of crossbow case 20 and foot stirrup 32 of the crossbow may be positioned through apertures 28 and 30. Foot stirrup 32 is external to crossbow case 20 while the remainder of the crossbow is positioned in interior compartment 25. In this position, foot stirrup 32 may also be used as a handle for carrying crossbow case 20.

Figure 11:
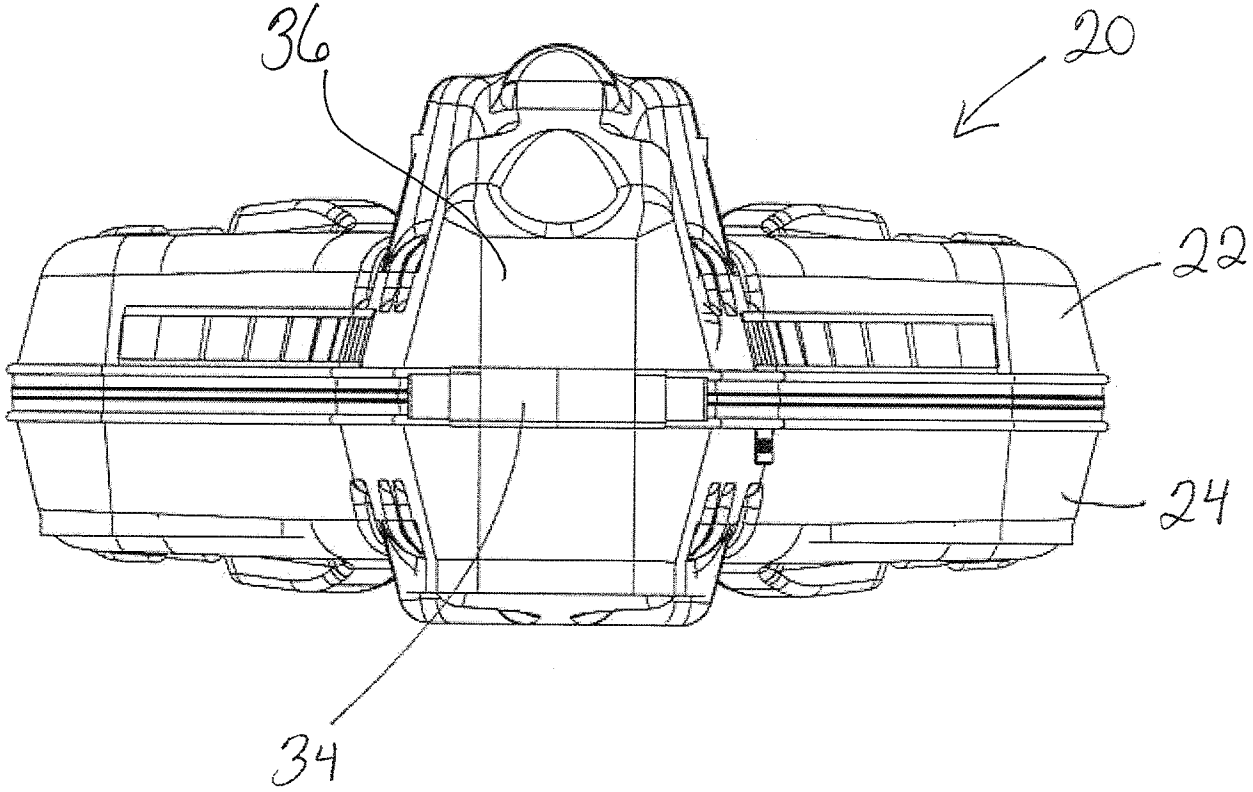
FIG. 11 is a rear view of the alternate embodiment of the crossbow case.

Referring to FIG. 11, crossbow case 20 may include hinges 34 at rearward end 36 of crossbow case 20. In an alternative embodiment, crossbow case 20 may include hinges 34 at forward end 26 of crossbow case 20. Conventional crossbow cases may include hinges along a side edge.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A crossbow case comprising an exterior shell and an interior compartment within the exterior shell, wherein the exterior shell comprises ethylene-vinyl acetate, wherein the interior compartment is configured to house a crossbow, and wherein the exterior shell includes an outer layer affixed to an exterior surface of the ethylene-vinyl acetate and an inner layer affixed to an inner surface of the ethylene-vinyl acetate.

2. The crossbow case of claim 1, wherein the interior compartment is configured to further house one or more crossbow accessories.

3. The crossbow case of claim 1, further comprising a foam insert is disposed within the interior compartment, the foam insert configured to secure a crossbow within the interior compartment.

4. The crossbow case of claim 3, wherein the foam insert is configured to further secure one or more crossbow accessories within the interior compartment.

5. The crossbow case of claim 1, wherein the exterior shell includes a camouflage pattern.

6. The crossbow case of claim 1, wherein the exterior shell includes a top member and a bottom member.

7. The crossbow case of claim 6, wherein the top member and the bottom member are connected with one or more hinges positioned at a forward end of the crossbow case.

8. The crossbow case of claim 6, wherein the top member and the bottom member are connected with one or more hinges positioned at a rearward end of the crossbow case.

9. The crossbow case of claim 1, wherein the exterior shell includes one or more apertures dimensioned to permit placement of a foot stirrup of the crossbow therethrough when the crossbow is housed within the interior compartment of the crossbow case.

10. The crossbow case of claim 9, wherein the one or more apertures are formed by the top member and the bottom member in a closed position.

11. The crossbow case of claim 1, wherein the exterior shell has a thickness of about 1/16 to about 1/4 of an inch.

12. A crossbow case comprising:

an exterior shell including a top member, a bottom member, and one more apertures through a front end of the exterior shell, wherein the exterior shell comprises ethylene-vinyl acetate;

one or more hinges secured to a rearward end of the top member and a rearward end of the bottom member for securing the top and bottom members in a hinged configuration; and an interior compartment within the exterior shell, wherein the interior compartment is configured to house a crossbow with a foot stirrup of the crossbow extending through the one or more apertures.

13. The crossbow case of claim 12, wherein the interior compartment is configured to further house one or more crossbow accessories.

14. The crossbow case of claim 12, further comprising a foam insert disposed in the interior compartment, the foam insert configured to secure a crossbow within the interior compartment.

15. The crossbow case of claim 12, wherein the exterior shell includes an outer layer affixed to an exterior surface of the ethylene-vinyl acetate and an inner layer affixed to an inner surface of the ethylene-vinyl acetate.

16. The crossbow case of claim 12, wherein the exterior shell has a thickness of about 1/16 to about 1/4 of an inch.

17. A cross bow case comprising:

an exterior shell including a top member and a bottom member pivotally connected by hinges secured to a rearward end of the top member and a rearward end of the bottom member, wherein the top and bottom members each comprises ethylene-vinyl acetate; and an interior compartment within the exterior shell, wherein the interior compartment is configured to house a crossbow;

wherein in a closed position, the top member and the bottom member form one or more apertures configured to allow passage therethrough of a crossbow foot stirrup.

18. The crossbow case of claim 17, wherein the exterior shell includes an outer layer affixed to an exterior surface of the ethylene-vinyl acetate and an inner layer affixed to an inner surface of the ethylene-vinyl acetate.

19. The crossbow case of claim 17, further comprising a foam insert disposed in the interior compartment, the foam insert configured to secure a crossbow within the interior compartment.

* * * * *